US007461605B2

(12) United States Patent
Rodrigues Couto

(10) Patent No.: US 7,461,605 B2
(45) Date of Patent: Dec. 9, 2008

(54) THREAD CONTROL DEVICE EMPLOYING A THREAD BRUSH, FOR A SEWING MACHINE

(75) Inventor: Paulo Eduardo Rodrigues Couto, Campinas (BR)

(73) Assignee: KSIN Luxembourg III, S.ar.l., Luxembourg (LU)

( * ) Notice: Subject to any disclaimer, the term of this patent is extended or adjusted under 35 U.S.C. 154(b) by 0 days.

(21) Appl. No.: 11/564,089

(22) Filed: Nov. 28, 2006

(65) Prior Publication Data

US 2007/0193484 A1 Aug. 23, 2007

Related U.S. Application Data

(63) Continuation-in-part of application No. 11/345,212, filed on Feb. 1, 2006, now abandoned.

(51) Int. Cl.
*D05B 47/00* (2006.01)
*D05B 49/00* (2006.01)

(52) U.S. Cl. ..... 112/254; 112/241; 112/302

(58) Field of Classification Search ..... 112/302, 112/253, 254, 255
See application file for complete search history.

(56) References Cited

U.S. PATENT DOCUMENTS

| | | | | |
|---|---|---|---|---|
| 860,546 | A | 7/1907 | Ives | |
| 2,581,142 | A * | 1/1952 | Rea | 242/154 |
| 2,862,468 | A | 12/1958 | Johnson | |
| 3,587,495 | A | 6/1971 | Johnson | |
| 4,241,679 | A | 12/1980 | Johnson | |
| 4,341,171 | A * | 7/1982 | Johnson | 112/250 |
| 4,413,578 | A * | 11/1983 | Rodda | 112/254 |
| 4,453,480 | A | 6/1984 | Larsen et al. | |
| 4,520,743 | A * | 6/1985 | Zylbert | 112/255 |
| 4,658,752 | A | 4/1987 | Keilmann et al. | |
| 4,776,292 | A | 10/1988 | Rodda et al. | |
| 4,793,273 | A | 12/1988 | Hara et al. | |
| 4,817,545 | A * | 4/1989 | Mikuni et al. | 112/241 |

(Continued)

FOREIGN PATENT DOCUMENTS

EP 1281800 A2 2/2003

(Continued)

OTHER PUBLICATIONS

European Search Report—Jun. 19, 2007.

*Primary Examiner*—Ismael Izaguirre
(74) *Attorney, Agent, or Firm*—Venable LLP; Eric J. Franklin; Ryan M. Flandro

(57) ABSTRACT

A sewing machine having a reciprocatory needle and a reciprocatory thread-take-up device to deliver thread to the needle employs a thread control device located between the thread take-up device and the needle to engage and apply light tension to the thread. The thread control device can have an opposed plate and spring wire between which the thread runs and which cooperate to apply spring pressure to the thread. Downstream thereof a thread brush can be employed through which the thread runs. The thread can be further lightly tensioned and laterally positioned by the thread brush. The guide plate or other device can include catcher structure to catch thread escaping the take-up device. The thread control device can help control premature descent of the thread and improperly tensioned stitches.

17 Claims, 5 Drawing Sheets

U.S. PATENT DOCUMENTS

| | | | |
|---|---|---|---|
| 4,949,657 | A | 8/1990 | Hanyu et al. |
| 5,069,150 | A | 12/1991 | Ogawa |
| 5,299,517 | A | 4/1994 | Ikawa |
| 5,887,533 | A | 3/1999 | Tsukioka et al. |
| 5,899,156 | A | 5/1999 | Schopf et al. |

FOREIGN PATENT DOCUMENTS

| | | | | |
|---|---|---|---|---|
| GB | 185697 | | | 9/1922 |
| GB | 283405 | A | | 1/1928 |
| JP | 4061889 | A | | 2/1992 |
| JP | 2002355464 | A | * | 12/2002 |

* cited by examiner

THREAD CONTROL DEVICE EMPLOYING A THREAD BRUSH, FOR A SEWING MACHINE

CROSS-REFERENCE TO A RELATED APPLICATION

This application is a continuation-in-part of my patent application Ser. No. 11/345,212 filed Feb. 1, 2006, now abandoned, the disclosure of which is incorporated by reference herein.

STATEMENT REGARDING FEDERALLY SPONSORED RESEARCH OR DEVELOPMENT (Not applicable.)

FIELD OF THE INVENTION

The present invention relates to a sewing machine mechanism and sewing machine incorporating same. The invention relates particularly, but not exclusively, to sewing machines intended for domestic or household use, and can be applied to industrial and other sewing machines, if desired. In general, the invention provides a novel and improved thread control device useful for such sewing machines.

BACKGROUND OF THE INVENTION

Thread management problems can readily arise in sewing machines that form lockstitches in a fabric or other sheet material by concatenating, or sewing together in a chain, two or more threads. The invention is also applicable to single thread sewing machines that are prone to thread management problems. For convenience, all such sewing machines will be referenced herein as "lockstitch machines" or "lockstitch sewing machines". The complexity of a typical lockstitch, requiring reciprocation of multiple thread guiding members, can sometimes cause too much or too little thread to be advanced to the work zone. Naturally, known sewing machines take measures to control such problems, providing thread tensioner systems and various thread guides to ameliorate same. Nevertheless, problems may still occur, for example surplus or tight thread at the needle, or difficulty in threading complex guide and tensioner mechanisms.

As is well known in the art, in two-thread lockstitch machines, an upper needle thread is supplied downwardly to the needle eye and a lower bobbin thread is supplied upwardly toward a work bed across which the fabric is moved as it is sewn. The fabric may have one or more layers.

The sewing machine needle can be mounted for vertical reciprocation on a crank-driven needle bar and the lower thread can be supplied from a bobbin via a shuttle reciprocating in a horizontal plane. The reciprocatory movement of the shuttle is suitably coordinated with that of the needle to form the desired stitch in the fabric on the down stroke of the needle. The dual reciprocatory motions of the needle and the shuttle may make it difficult controllably to feed the two threads to the work area without occasionally generating surplus loops of thread or undue tautness in the thread. Loops may become entangled in the machinery, while excessively taut thread can break, jam the machine or cause mechanical damage.

A detailed description of one way of forming a variety of lockstitches may by found, for example, in U.S. Pat. No. 2,862,468 of R. E. Johnson for "Ornamental Stitches Sewing Machines" issued Dec. 2, 1958 and assigned to The Singer Company. Other means, mechanisms or ways of forming lockstitches or other appropriate stitches will be apparent to those skilled in the art and can be employed in the practice of the present invention, if desired. The described thread tension mechanism is formed by two circular discs for pressure the thread and make the tension in accordance the dial number selected and one check spring for control the quantum of the thread during machine sewing in relation the fabric thicknesses or type of the stitch used.

Notwithstanding the above and other proposals in the art, some sewing machines may nevertheless be subject to thread management problems wherein the thread becomes undesirably slack or taut.

The foregoing description of background art may include insights, discoveries, understandings or disclosures, or associations together of disclosures, that were not known to the relevant art prior to the present invention but which were provided by the invention. Some such contributions of the invention may have been specifically pointed out herein, whereas other such contributions of the invention will be apparent from their context. Merely because a document may have been cited here, no admission is made that the field of the document, which may be quite different from that of the invention, is analogous to the field or fields of the present invention.

SUMMARY OF THE INVENTION

In one aspect, the invention provides a sewing machine comprising a needle mounted for reciprocal movement toward and away from a workpiece. The sewing machine further comprises a reciprocating thread take-up device to control the supply of a thread to the needle and workpiece and a thread control device. The thread control device can comprise a thread brush, or other suitable device, located between the thread take-up device and the needle to engage, position and apply tension to the thread as the thread moves between the take-up device and the needle.

The invention furthermore provides a sewing machine wherein the demand for thread can be controlled by stitch formation. Optionally the thread demand is not entirely determined by, or can even be somewhat independent of the thread take-up device or a return spring for the thread take-up device.

The invention also provides a sewing machine wherein the thread control device controls the thread tension before needle penetration of the fabric and controls the timing of the thread take-up device in the down position.

The thread control device can comprises a guide plate having a thread-engagement surface extending in the direction of travel of the thread between the take-up device and the needle and the thread can run across the thread-engagement surface during operation of the sewing machine.

The thread control device provided by the invention can help control premature descent of the thread and improperly tensioned stitches.

One embodiment of the invention comprises a thread-control device for a sewing machine, particularly but not exclusively for a lockstitch sewing machine, which device is effective and can be easily threaded. The thread control system or device can comprise two opposed plates between which the thread runs and which cooperate to apply spring pressure to the thread. The opposed plates can comprise a guide plate, a spring wire and thread retaining brush which engage and control the thread as it is supplied to the needle. The invention includes embodiments wherein the thread moves approximately in a straight line as it travels through the thread control device. The thread can move approximately in a straight line.

In one useful embodiment of the invention, the spring wire and the thread brush applies only a light restraining force to the thread. The restraining force may be sufficient to control the thread flux to the needle and light enough to permit unimpeded retraction of the thread with the retreating needle. In a further embodiment of the invention, the guide plate can have an external profile which helps prevent premature descent of the thread which may result in improperly formed stitches. The guide plate can be profiled in such a way as to support the thread during descent of the take up lever.

Another embodiment of guide plate is constructed to catch thread that may escape a thread take-up device during downward travel of same. For this purpose, the guide plate may include suitable thread catcher structure, for example, a slot or groove beneath the spring wire defined by an upwardly and forwardly (referring to the user) projecting shoulder. The catcher action can be facilitated by a suitably positioned wire guide.

Many sewing machines, including lockstitch machines, employ a thread take up lever to manage the delivery of thread to a vertically reciprocating needle. When employed in such sewing machines, a thread-control device according to the invention can be positioned between the take-up lever and the needle, which is to say downstream of the take-up lever.

The invention is also suitable for use with sewing machines having a thread tensioner comprising a pair of relatively movable tensioning discs. In sewing machines employing a take-up lever, such thread tensioners are often located upstream of the take-up lever. In such machines, the thread-control device of the invention can be located downstream of the thread tensioner, if desired.

In a further embodiment of sewing machine employing tensioning discs and a take-up lever or similar device, during the passage of thread from the tensioner discs to the thread take-up device, with the tensioner discs in a closed condition, a shoulder on the large plate of the thread control device and an associated wire guide cooperate to catch thread from take-up lever and pull thread through the spring wire and large plate.

One benefit obtainable in the practice of the present invention is the provision of a thread control device which can tension or control the thread downstream of a take-up lever preventing an initial rapid descent of thread in the device resulting in slack thread and improper stitch formation and which nevertheless applies only a light restraining force to thread moving through the device.

The invention also provides a sewing machine embodiment having an effective thread-control device which employs a thread-engageable plate and wire located downstream of a thread take-up mechanism and applies only a light restraining force to the moving thread to increase the tension in the moving thread. In such a sewing machine, the thread-engageable plate and wire help predetermine the demand for thread made by the needle and loop taker and to feed the thread accordingly.

The invention includes sewing machine embodiments comprising a thread-control device employing a large plate formed with a forwardly projecting shoulder which partly defines a slot. A suitably shaped wire guide is positioned adjacent the slot and is cooperative with the slot and shoulder to help catch the thread during thread take-up even if the thread does not properly enter the thread tension device.

Other objects and advantages of the invention maybe possible see during a reading of the specification taken in connection with accompanying drawings.

BRIEF DESCRIPTION OF THE SEVERAL VIEWS OF THE DRAWING

Some embodiments of the invention, and of making and using the invention, as well as the best mode contemplated of carrying out the invention, are described in detail below, by way of example, with reference to the accompanying drawings, in which like reference characters designate like elements throughout the several views, and in which.

DETAILED DESCRIPTION OF THE INVENTION

The following more detailed description of the invention is intended to be read in the light of, and in context with, the preceding summary and background descriptions but without being limited by the preceding descriptions.

Throughout the description, where structures are described as having, including, or comprising specific components, or where processes are described as having, including, or comprising specific steps, it is contemplated that compositions of the present invention may also consist essentially of, or consist of, the recited components.

In one useful embodiment of lockstitch sewing machine according to the invention, the thread extends from a horizontally mounted spool pin to a thread guide, a pretension guide and thence to a disc-type thread tensioner. After these thread-control devices, the thread runs through a take-up device, for example a lever, through a thread-control device provided pursuant to the invention and thence to the needle. The take-up device sets stitches and pulls slack thread back through the thread control device. The take-up device moves the thread back and forth in the thread control device. In one direction, the take-up device moves to a stitch position at one end of its operating range. In the opposite direction, the take-up device moves to a position where it is free of the thread, at the other end of its operating range. After the take-up device moves to the end of its operating range, thread in the device moves to a position of reengagement with the take-up device to shorten the path for thread between the thread tensioner and the needle, making a quantity of thread available for use by the needle and loop taker.

In one embodiment, the invention provides a thread handling or thread-control device for a domestic sewing machine which device comprises two plates projecting from the sewing machine head which contact the thread as it runs between the plates.

Figure 1:
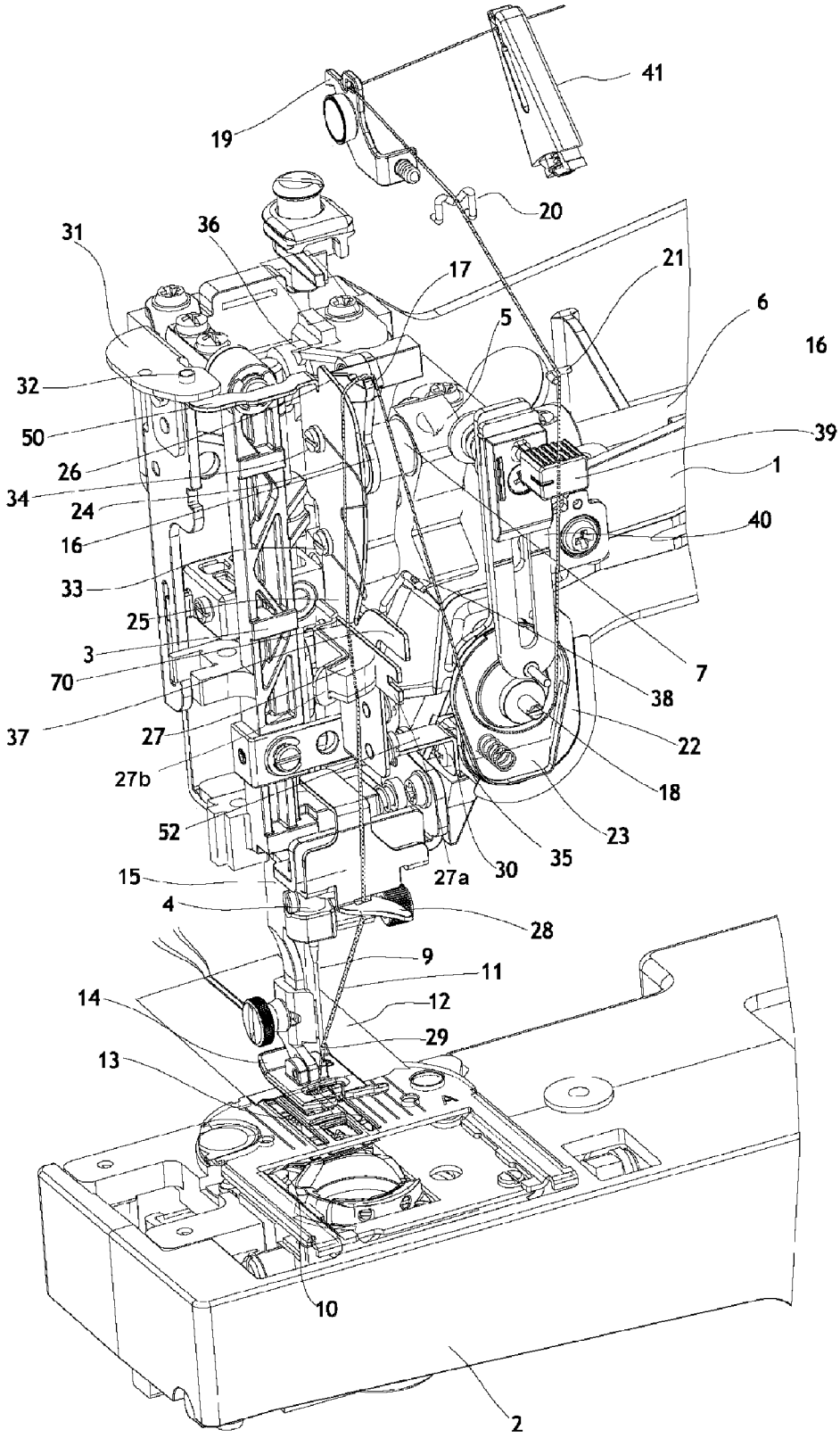
FIG. 1 is a front perspective view of a head end portion of a domestic sewing machine, with covers removed, showing portions of a thread-control device according to one embodiment of the invention.
Figure 2:
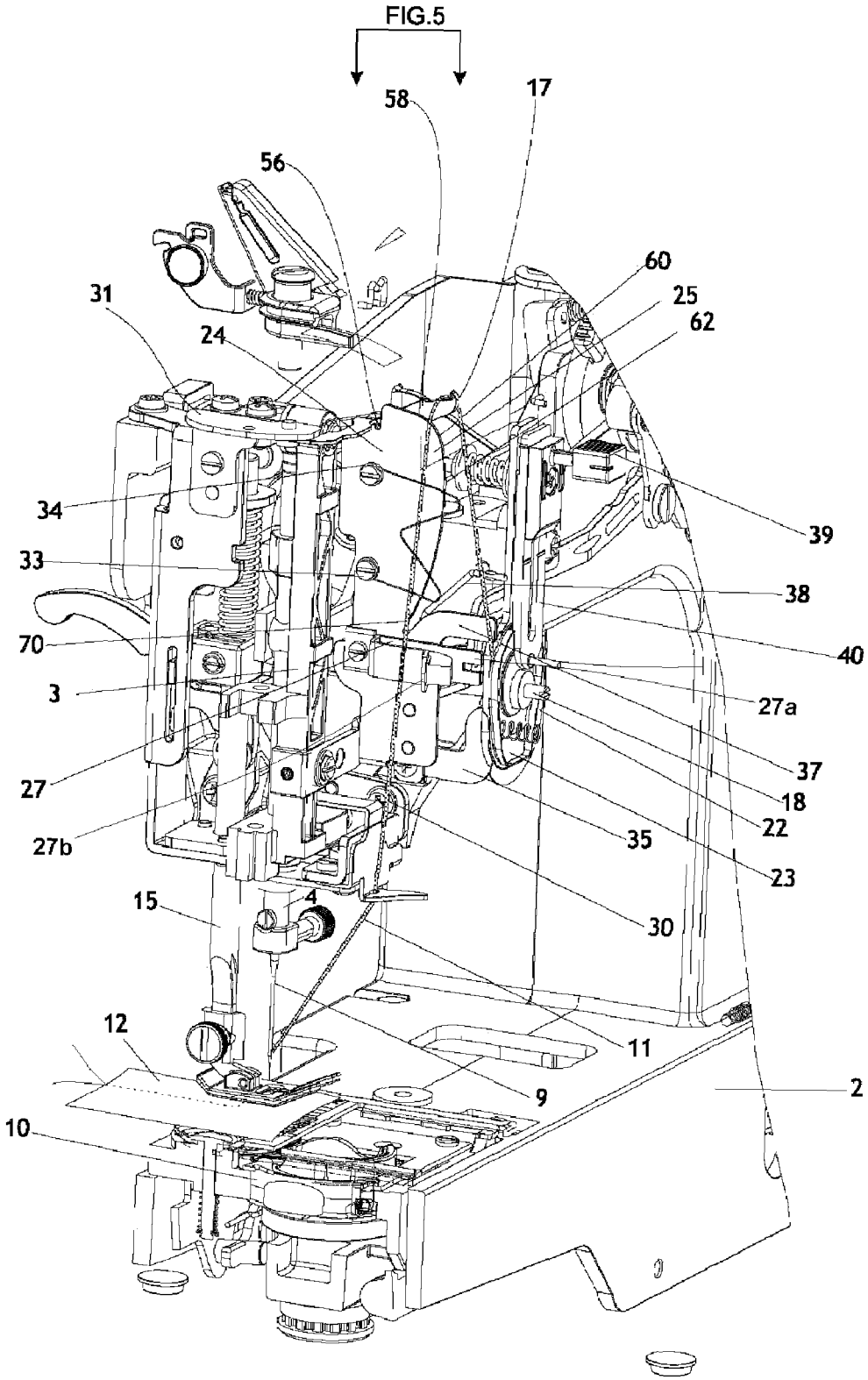
FIG. 2 is lefthand perspective view of the head-end sewing machine portion shown in FIG. 1, with a further cover below the needle removed, showing the thread-control device illustrated in FIG. 1 from a different perspective.
Figure 3:
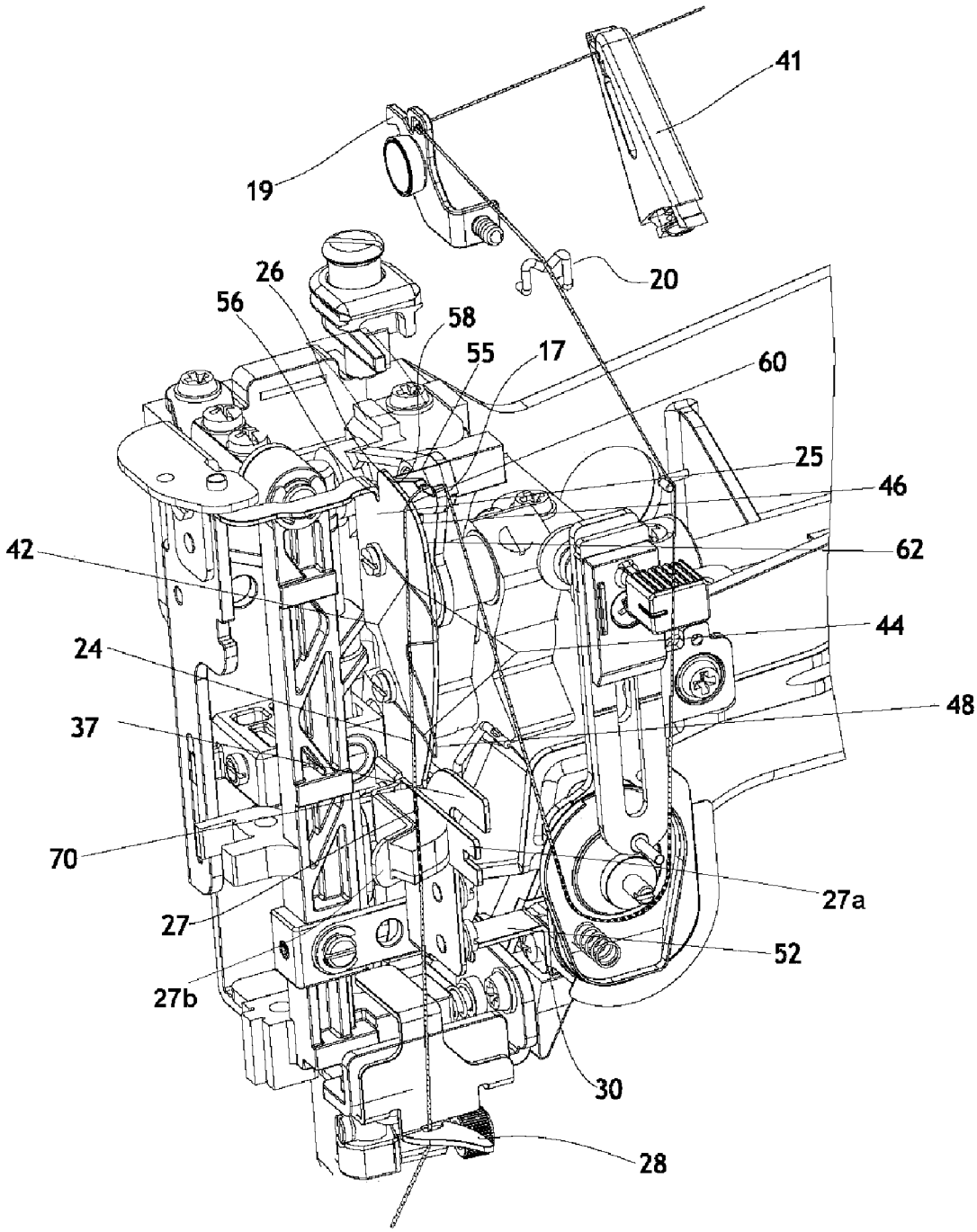
FIG. 3 is a view similar to FIG. 2 of the upper portion of the thread-control device there shown with the thread in a first position during descent of the needle.
Figure 4:
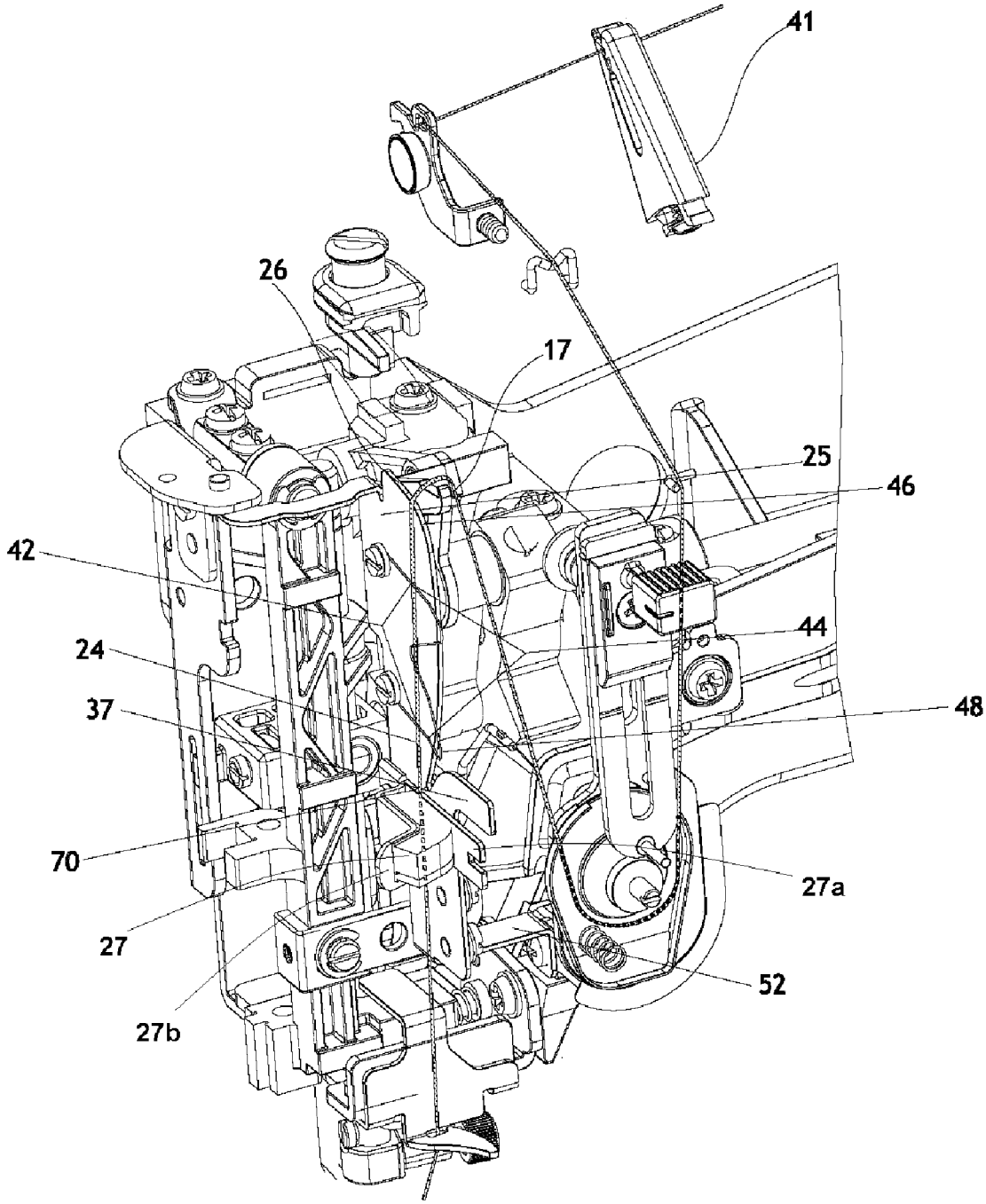
FIG. 4 is a view similar to FIG. 3 showing the thread in a second position during descent of the needle.
Figure 5:
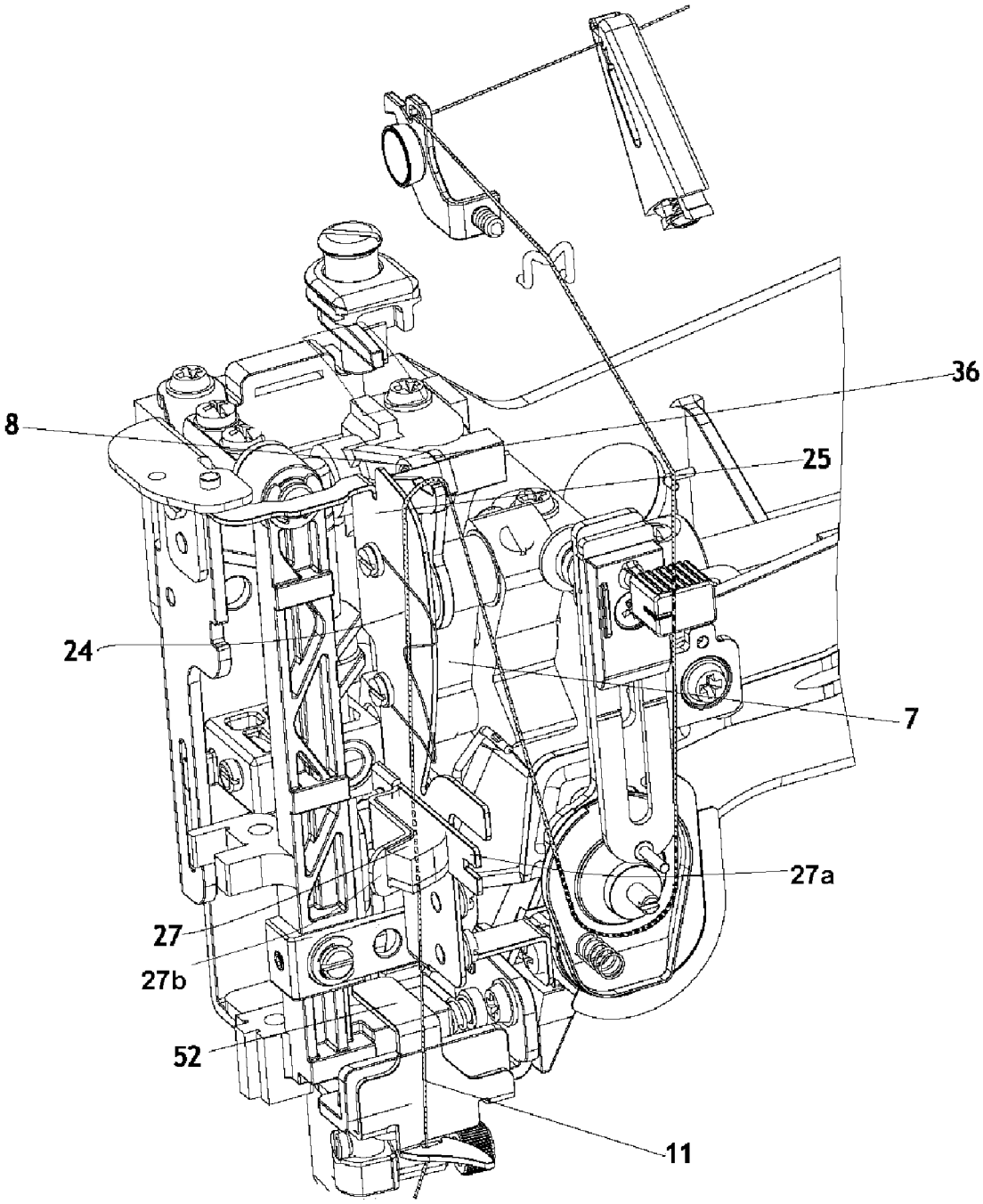
FIG. 5 is a view in the direction of the line 5-5 of FIG. 2 showing the thread-control device from a different angle along, a wire guide for the thread and the thread held in a take-up lever.

Referring to FIGS. 1 and 2 of the drawings, the illustrated head end portion 1 of a domestic sewing machine useful for sewing in a household or other domestic environment or other suitable location includes a work bed 2 and a sewing machine head 3. Only a portion of the complete sewing machine is shown. The structure not shown can take any suitable form, as is well known in the art an may for example comprise a portable unit or a table-mounted unit. While it is envisaged that the invention is particularly useful when embodied in a unit supported or mounted on a tabletop, bench or the like for operation by a seated user, it will be understood that the invention can be embodied in other sewing machines, as will be or may become apparent. Directional references such as "front", "rear" or "behind", "up", "down", "left" and "right" are to be understood as being from the perspective of such a user As shown in the drawings, a needle bar 4 is driven for reciprocatory up-and-down motion by a counterbalanced crank 5. Crank 5 is connected to needle bar 4 via a shaft arm 6, a connecting link 7, and a pivot 8. Connecting link 7 drives needle bar 4 up and down in synchronism with rotating hook 10, as may be understood from FIGS. 1 and 5.

A needle 9 is mounted on needle bar 4. In the downward position of needle bar 4 needle 9 synchronizes with a rotating hook 10. Rotating hook 10 is carried, in work bed 2, on a reciprocatory hook drive assembly, which drives hook 10 in timed relationship with shaft arm 6. In cooperation with moving needle 9, thread 11 is drawn from a bobbin (not shown) by hook 10 to form lockstitches. A detailed description of one way in which such lockstitches can formed may by found, for example, in U.S. Pat. No. 2,862,468 of R. E. Johnson for "Ornamental Stitches Sewing Machines" issued Dec. 2, 1958 and assigned to The Singer Company. Other means, mechanisms or ways of forming lockstitches or other appropriate stitches will be apparent to those skilled in the art and can be employed in the practice of the present invention, if desired.

A fabric 12 to be stitched is fed across work bed 2 by a feed dog 13. The movement of fabric 12 is controlled by user pressure on a presser foot 14 which is affixed to a presser bar 15. Feed dog 13 is also moved in timed relationship with needle 9 and rotating hook 10 by a suitable feed mechanism as is known in the art.

Thread 11 is supplied to the needle 9 by a thread-control device 16, a take-up lever 17 and a thread tensioner 18. Thread tensioner 18 comprises a pair of cooperative tension discs 22 and 23 which can be opened to permit relatively free travel of thread 11, or closed to tension it. Thread-control device 16 comprises an opposed spring wire 24 and a guide plate 25, which wire 24 and plate 25 are described in more detail hereinbelow, and are located generally in the vicinity of needle 9. For example, thread-control device 16 can be located just upstream of needle 9, more or less directly above needle 9.

During operation of the sewing machine, thread 11 is drawn from a spool carried on a horizontal spool pin (neither one shown) through thread guides 41, 19, 20 and 21 to thread tensioner 18. Thread guide 41 can, as illustrated, comprise a clamp in the form of a crocodile clip which lightly grips the thread at two locations spaced apart along the thread. Such a clamping guide can prevent twisting of the thread before it enters guide 19 and can help reduce variations in thread tension as sewing progresses. The thread passes between tension discs 22 and 23 of tensioner 18 to thread take-up lever 17 and then runs over profile 26 of guide plate 25 down through thread-control device 16. Here, opposed wire 24 and plate 25 embrace and apply light pressure to grip thread 11 and control its travel.

Downstream of thread take-up lever 17 and thread-control device 16, thread 11 passes through a thread brush 27 and a thread guide 28 which introduce thread 11 into the vicinity of needle bar 4 and thence to needle 9 through the eye 29 of which the thread is threaded. During each stitch cycle, thread 11 is moved upwardly through thread-control device 16 by thread take-up lever 17 and is drawn downwardly off take-up lever 17 by the downward movement of needle 9 and hook 10. On the downstroke, needle 9 applies tension to thread 11 drawing it downwardly. On the upstroke as needle 9 moves upwardly, thread 11 goes slack in the vicinity of the needle.

Thread brush 27 can comprise any suitable structure which will engage with, and apply a light pressure, to thread 11. The pressure can be less than about 10 grams, for example about 2 grams. Desirably, thread brush 27 also helps to position thread 11 laterally of its direction of travel to help maintain a desired alignment. In one embodiment, thread brush 70 comprises a strip or block of soft, yielding material mounted on a rigid backing plate 27*a* by adhesive or other suitable means. Backing plate 27*a* can be supported, at an inward end, on a finger 27*b*. Finger 27*b* and backing plate 27*a* both project outwardly from the sewing machine toward the user. Backing plate 27*a*, curves to the left as viewed in FIG. 1, so that thread brush 27 defines a cleft into which thread 11 can readily be inserted.

Thread brush 27 can have a significant vertical depth, in cross-section, which can be comparable with its horizontal projection from backing plate 27*a* so that it has a blocky appearance as shown in FIG. 1. Thread brush 27 can be formed of foam, felt or other suitable material. In one embodiment thread brush 27 comprises a mass or bristles or fibers projecting from backing plate 27*a*, so that thread 11 can run between the bristles or fibers. Desirably, the bristles or fibers have modest resilience and they can be formed of a synthetic polymeric material, or other suitable material, for example nylon or oriented polypropylene. In this way, or another suitable manner, thread brush 27 closely embraces thread 11 in a yielding manner to guide it.

In addition, thread brush 27 can, in some cases, remove fuzz from thread 11 as thread 11 runs through thread brush 27.

Thread tensioner 18 is mounted on the front of the machine, facing the user, on or outside the front cover (not shown). For example, tensioner 18 can be carried by an angle bracket 35 secured to sewing machine head 3 by a screw 30. Tensioner 18 is disposed on the right side of the thread-control device 16, as viewed in FIG. 1, in an appropriate position having regard to the operating range of take-up lever 17. The thread tension may be adjusted by varying the position of a slide knob 39 which is vertically slidable along a slotted track 40.

When slide knob 39 is moved between its up and down positions along slotted track 40, tension discs 22 and 23 pressure the thread more or less, and increase or decrease the tension in thread 11, depending upon the position to which slider knob 39 is adjusted.

Thread take-up lever 17 is fixed to shaft arm 6 by a take-up link 36 and is pivotally connected to connecting link 7 and crank 5. Rotation of shaft arm 6 causes take-up lever 17, driven by crank 5 and guided in its motion by link 36, to impart reciprocatory up-an-down motion to take-up lever 17 along the right side of the guide plate 25, in timed relationship with needle 9 and rotating hook 10. Thread take-up lever 17 has a hook 55 terminating in a point and is suitably angled to receive and guide the thread 11 after threading the machine and after casting-off.

Guide plate 25 also has, beneath spring wire 24, a slot 70 defined by a projecting shoulder 37 and a wire guide 38 carried by, and adjacent to, shoulder 37. Shoulder 37 and wire guide 38 cooperate to help take-up lever 17 catch thread 11 when threading the machine with presser bar 15 down and tension discs 22 and 23 closed. Loose thread likely will encounter projecting shoulder 37 and/or wire guide 38 and be steered by their shapes into slot 70 where it is well positioned to be picked up by take-up lever 17. Thread escaping during operation of take-up lever 17 may also be captured or retained in this way.

Guide plate 25 is relatively larger than spring wire 24 and can be securely affixed to sewing machine head end 3 in any suitable manner. For example, as shown, guide plate 25 can be affixed at two points. In the illustrated embodiment, a first bracket 50 is attached, at one end, to a presser bar plate 31 mounted on sewing machine head 3, by a screw 32. The other end of bracket 50 is angled to engage and hold guide plate 25 at one point at the upper end of the guide plate. If desired, bracket 50 can be welded to guide plate 25. Alternatively, bracket 50 can be formed as an integral extension of guide plate 25, for example as a metal sheet stamping. Similarly, the lower end of guide plate 25 can have a downward extension 52 attached to machine head 3. In the illustrated embodiment, spring wire 24 is affixed to guide plate 25 by two or more screws 33 provided with washers 34. Other devices or means for securely affixing guide plate 25 to machine head 3 will be, or become, apparent to those skilled in the art.

Desirably, guide plate 25 is configured and positioned to provide support for thread 11 during descent of take up lever 17. Suitable guide plates 25, such as that shown, can comprise a flat plate of relatively sturdy construction to support spring wire 24 during normal use of the sewing machine. As shown, guide plate 25 has an elongated shape, extending in the vertical direction along the path of travel of thread 11 as it moves from take-up lever 17 to needle 9. Also in the embodiment shown, guide plate 25 extends downwardly to support thread guide 27 and other useful structures. It will be understood that guide plate 25 can have a variety of other structures and forms that enable it to provides a suitable support or bearing surface over which thread 11 can smoothly run. For example the monolithic plate 25 shown could alternatively be formed of a number of component parts.

In one embodiment of the invention guide plate 25 can be fabricated of steel, preferably a stainless steel, and may have a polished surface provided with a nickel-chromium-plated bright finish. Desirably, guide plate 25 provides a low-friction, durable contact surface for thread 11 over which thread 11 can run under light pressure applied by spring wire 24. While smooth materials other than polished steel can be employed, for long life, guide plate 25 desirably can be formed of a durable hard material, such as steel, which resists wear. Alternatively, if desired, guide plate 25 could have a low friction surface provided by a polymer material such as polytetrafluoroethylene, which could be a replaceable insert or component.

To help control the thread descent, guide plate 25 has an upper profile 26, over which thread 11 passes, which profile 26 can have a form which extends approximately horizontally toward the user, away from sewing machine head 3, on which thread 11 can rest or be supported during descent of thread 11. Desirably, profile 26 is shaped to work cooperatively with take-up lever 17 which has a hook 55 to receive thread 11, to help position the thread laterally. Usefully, upper profile 26 of guide plate 25 can terminate rearwardly in a notch 56 to seat the sewing machine cover (not shown). By way of example of one suitable construction, upper profile 26 of guide plate 25 can, as illustrated, comprise a straight, slightly inclined land 58 joining a curved or rounded shoulder 60 which leads to a straight vertical edge 62 facing the user. The forward incline of profile 26 of guide plate 25 may guide thread 11 toward hook 55. Shoulder 60 can help position thread 11 between guide plate 25 and spring wire 24 during upward movement of the thread take-up lever 17, if necessary.

Spring wire 24 is constructed to overlie and apply light pressure to thread 11 as the thread runs across guide plate 25. In the illustrated embodiment, spring wire 24 has a "W" shape with its ends 42 anchored by screws 33 and 34 and the points 48 of the "W" projecting forwardly toward the user. This extended configuration enables spring wire 24 to apply light pressure over a significant length of thread 11. Furthermore, spring wire 24 has a significant lateral extent to accommodate side-to-side movement of thread 11. Spring wire 24 can have other suitable shapes, including for example a "U" shape, a "V" shape or a sinuous shape.

Manually applied pressure on one or both of the points of the "W" enables spring wire 24 readily to be pried away from guide plate 25 to permit entry of thread 11 between spring wire 24 and guide plate 25 during loading of the thread.

Spring wire 24 can be fabricated of any suitable resilient material having a low-friction surface, for example, a spring steel wire. In one embodiment, the spring wire can have a diameter of from about 0.2 mm to about 0.4 mm, and desirably also can have a polished surface. Wires of other suitable diameters, for example a diameter of from about 0.1 mm to about 0.5 mm, and other materials or finishes can be employed for wire 24, if desired. Spring wire 24 provides an economical construction.

During operation of the sewing machine, take-up lever 17 moves up and down in timed relation to rotating hook 10. When take-up lever 17 is in an upper position, thread 11 is at its uppermost position in thread-control device 16 extending over profile 26 on the upper side of guide plate 25. When take-up lever 17 starts to move downwardly, thread 11 is temporarily retained on the top of guide plate 25, on profile 26 and on brush 27. The configuration of profile 26 and the brush 27 helps keep thread 11 on or in thread-control device 16 during the descent of the take up lever, avoiding excess slack. In the event that thread 11 should escape thread-control device 16, the light spring construction of wire 24, and tab portion 44 thereof, enable thread 11 to be easily reinserted between wire 24 and plate 25 on the upstroke of take-up lever 17.

As needle 9 moves downwardly, profile 26 of guide plate 25, the force applied by spring wire 24 and brush 27, cooperate to apply a small frictional grip to thread 11, thereby maintaining a controlled tension in the thread as it is drawn through the machine. The resultant controlled tension can prevent an excess of thread 11 being supplied to needle 9 and help avoid variation in stitch tension, stitch skipping or formation of pigtails on the fabric.

As the take-up lever 17 moves upwardly in the device, slack thread cast off rotating hook 10 is pulled upwardly by take-up lever 17 to provide for the formation of the stitch in the material being sewn. Construction of spring wire 24 to exert a light tensioning force on thread 11 enables slack in the thread 11 to be quickly removed by thread take-up lever 17 without applying excessive tension to the thread which might otherwise result in slippage through thread tensioner 18 and an undesired pulling of thread from the supply spool in advance of stitch setting.

Novel thread control devices provided pursuant to the invention, for example thread-control device 16, also provide the benefit of being easy to thread manually.

When the user sets up the sewing machine, thread can easily be passed through the thread control device by guiding it while moderately taut into the jaws provided by spring wire 24 and guide plate 25. The modest resilience of spring wire 24 and the brush resistance permits the plate readily to adapt to receive the thread.

The foregoing detailed description is to be read in light of and in combination with the preceding background and invention summary descriptions wherein partial or complete information regarding the best mode of practicing the invention may be set forth and where modifications, alternative and useful embodiments of the invention may be suggested or set forth, as will be apparent to one skilled in the art.

While illustrative embodiments of the invention have been described above, it is, of course, understood that many and various modifications will be apparent to those of ordinary skill in the relevant art, or may become apparent as the art develops. Such modifications are contemplated as being within the spirit and scope of the invention or inventions disclosed in this specification.

The invention claimed is:

1. A sewing machine comprising:

a) a needle mounted for reciprocal movement toward and away from a workpiece;

b) a reciprocating thread take-up device to control a supply of a thread to the needle and the workpiece; and c) a thread control device comprising a thread brush located between the thread take-up device and the needle along a path of travel of the thread to engage, position and apply tension to the thread as the thread moves between the take-up device and the needle, wherein the thread control device comprises a guide plate and a spring wire cooperable with the guide plate to apply spring pressure to the thread, wherein the thread runs between the guide plate and the spring wire during operation of the sewing machine.

2. A sewing machine according to claim 1, wherein the a guide plate includes a thread-engagement surface extending in the direction of travel of the thread between the thread take-up device and the needle and wherein the thread can run across the thread-engagement surface during operation of the sewing machine.

3. A sewing machine according to claim 1, wherein the guide plate, the spring wire and the thread brush engage the thread to control a thread flux before penetration of the needle into the workpiece and to control the timing of the thread take-up device in a down position.

4. A sewing machine according to claim 1, wherein the thread moves approximately in a straight line as it travels through the thread control device.

5. A sewing machine according to claim 3, wherein the spring wire and the thread brush each apply a light restraining force to the thread.

6. A sewing machine according to claim 3, wherein the spring wire and the thread brush each apply to the thread a restraining force sufficient to control feed of surplus thread to the needle and light enough to permit unimpeded retraction of the thread as the needle retreats.

7. A sewing machine according to claim 3, wherein the spring wire is formed of spring steel wire having a diameter of from about 0.2 mm to about 0.4 mm.

8. A sewing machine according to claim 3, wherein the guide plate has an external profile shaped to support the thread during descent of the thread take-up device.

9. A sewing machine according to claim 3, wherein the guide plate is configured to catch thread escaping the thread take-up device during downward travel of the thread take-up device.

10. A sewing machine according to claim 9, wherein the guide plate has a thread catcher structure comprising a slot beneath the spring wire defined by an upwardly and forwardly projecting shoulder.

11. A sewing machine according to claim 9, comprising a wire guide positioned to facilitate the thread catching action.

12. A sewing machine according to claim 3, being a two-thread lockstitch sewing machine wherein a second thread is supplied to the needle from a reciprocating bobbin beneath a work bed across which the workpiece is moved as it is sewn, wherein the workpiece is fabric.

13. A sewing machine according to claim 12, being intended for domestic use and oriented in use for the needle to move in an approximately vertical direction.

14. A sewing machine according to claim 12, further comprising a thread tensioner located upstream of the thread take-up device.

15. A sewing machine according to claim 14, wherein the thread tensioner comprises a pair of relatively movable tensioning discs.

16. A sewing machine according to claim 1, wherein a thread demand is controlled by stitch formation and optionally not by the thread take-up device or a return spring for the thread take-up device.

17. A sewing machine according to claim 1, wherein the thread control device controls tension in the thread before needle penetration of the workpiece and controls the timing of the thread take-up device in a down position.

* * * * *